US005811975A

United States Patent [19]

Bernardo

[11] Patent Number: 5,811,975

[45] Date of Patent: Sep. 22, 1998

[54] APPARATUS AND METHOD FOR ELECTRONIC TESTING AND MONITORING OF EMERGENCY LUMINARE

[76] Inventor: James Segura Bernardo, 7 Meadow St., Goldens Bridge, N.Y. 10526

[21] Appl. No.: 716,804

[22] Filed: Sep. 9, 1996

[51] Int. Cl.[6] ..... G08B 1/00; G08B 21/00

[52] U.S. Cl. ..... 324/414; 340/641; 320/21

[58] Field of Search ..... 340/515, 516, 340/641, 642, 636; 320/14, 15, 19, 21; 324/414

[56] References Cited

U.S. PATENT DOCUMENTS

| | | | |
|---|---|---|---|
| 4,544,910 | 10/1985 | Hoberman | 320/48 |
| 4,580,099 | 4/1986 | Zetti | 324/414 |
| 4,894,601 | 1/1990 | Watkins | 320/14 |
| 4,945,280 | 7/1990 | Beghelli | 340/515 |

*Primary Examiner*—Ernest F. Karlsen
*Assistant Examiner*—Jose M. Solis
*Attorney, Agent, or Firm*—Michaelson & Wallace

[57] ABSTRACT

The present invention is an apparatus and method for electronically monitoring and testing the operational status of emergency luminare in a building at predetermined times for predetermined intervals, accurately, quickly, non-intrusively. The apparatus includes a programmable processor pre-programmed with programmed information for producing electrical input signals at predetermined times for predetermined intervals, a plurality of switches receiving the electrical input signals and electronically coupled between the programmable processor and the plurality of emergency luminare for deactivating the power source and activating the battery source, and a plurality of detectors electronically coupled between the emergency luminare and the programmable processor for collecting data of the operational status of the emergency luminare. The programmable processor receives and stores the data in a memory device for monitoring by a user accessible computer.

20 Claims, 3 Drawing Sheets

APPARATUS AND METHOD FOR ELECTRONIC TESTING AND MONITORING OF EMERGENCY LUMINARE

BACKGROUND OF THE INVENTION

1. Field of the Invention

This invention relates in general to electrical monitoring systems, and in particular, to programmable electrical monitoring systems for monitoring and testing the operational status of battery powered emergency luminare, battery backup devices and/or equipment.

2. Description of the Related Art

Maintenance and safety codes typically require buildings to be equipped with various emergency fixtures or luminary devices such as lighted exit signs, florescent and sealed beam lights, and wall packs. The emergency luminare are usually powered by a continuous power source. In addition, the emergency luminare have back-up battery sources.

The emergency luminare also have internal circuitry connected to the power source of the building. The internal circuitry detects the on/off power status of the building. If the building's power is on, then the internal circuitry of a particular luminary device opens a battery circuit which deactivates the battery source. If however, the building's power is off, then the internal circuitry of a particular luminary device closes the battery circuit which activates the battery source to provide battery operated power to the particular luminary device.

Under normal conditions, the power source is on and operating the luminare while the battery sources are off and in the inactive state. However, during an interruption of the power source, such as a power failure or a power malfunction, the battery sources power the respective luminare or respective devices or systems and activate the respective luminare. Thus, since interruptions in the power source are unpredictable, it is critical that each battery source be capable of providing operating power to the luminare at any given time.

To ensure that the battery source of a particular emergency luminary device, or system provides the required power to activate the particular emergency luminary device during an emergency, periodic testing of the battery source according to applicable codes and/or manufacturers' recommendations is necessary. Further, testing and monitoring of lighting elements of the emergency luminare is required to ensure that the lighting elements illuminate the luminare and/or area proximate to the luminare when the power source of a building is interrupted or malfunctions.

However, emergency testing methods currently employed are manual, and hence are tedious and prone to error, time consuming, and costly. For example, a typical testing method requires a field technician to check each emergency luminary device in a building. For each luminary, the technician first deactivates the power source of the luminary. Next, the technician observes the luminary in accordance with applicable codes or manufacturers' recommendations to determine if the battery source of a particular luminary and its lighting elements are properly functioning. The technician keeps a data log on the operational status of each luminary.

In addition to being prone to human error, time consuming, and costly, manual testing is inconvenient because testing usually takes place when the building is not occupied. This is typically during a five to six hour period starting at midnight. Further, technicians entering an unoccupied building are a security risk and also expose the building's owners to possible liability. Moreover, due to manpower limitations, random tests are usually not performed. Instead, emergency luminare have scheduled test dates, which are typically only once every month. Thus, this inflexible testing schedule compromises the integrity and reliability of emergency luminare.

Therefore, there is a need for a device that provides a time efficient, inexpensive, non-intrusive, and accurate method of testing emergency luminare. In addition, an electronic method is needed to quickly and precisely test emergency luminare at any time for variable testing periods without the need for entry into a building. What is further needed is a testing method which eliminates human error of manual testing.

Whatever the merits of the prior techniques and methods, they do not achieve the benefits of the present invention.

SUMMARY OF THE INVENTION

To overcome the limitations in the prior art described above, and to overcome other limitations that will become apparent upon reading and understanding this specification, the present invention discloses an apparatus and method for electronically monitoring and testing the operational status of emergency luminare with battery sources in a building at predetermined times for predetermined intervals, accurately, quickly, inexpensively, and non-intrusively.

The invention includes a programmable processor with memory for data storage, a plurality of switches, each coupled to a respective emergency luminary device within a facility housing such luminare, such as a building, for activating the emergency luminare, and a plurality of detectors, each coupled to a respective emergency luminary for detecting if the luminary devices are properly operating. The programmable processor is programmed according to applicable code specifications or manufacturers' recommendations to provide input signals to the switches at predetermined times for predetermined intervals.

The input signals turn the switch of the respective luminare on, which interrupts the building's power source to the respective emergency luminare and activates the battery source of the respective luminare, to thereby provide battery power to the respective luminare. The detectors then detect if the respective luminare are functioning properly. Output signals produced by the detectors are sent to the processor and are stored by the processor as data on the operational status of the respective luminare.

A feature of the present invention is the quick and precise testing of a specified number of emergency luminare by electronically switching a respective luminary on and testing it over programmed time intervals according to building code specifications. Another feature of the present invention is the simultaneous testing of all emergency luminare, apparatus, or equipment.

An advantage of the present invention is that it limits the dependency on human testers which eliminates the possibility of human error. Another advantage of the present invention is that it reduces costs involved with testing emergency luminare and eliminates the need for physical entry into a building.

The foregoing and still further features and advantages of the present invention as well as a more complete understanding thereof will be made apparent from a study of the following detailed description of the invention in connection with the accompanying drawings and appended claims.

DESCRIPTION OF THE DRAWINGS

Referring now to the drawings in which like reference numbers represent corresponding parts throughout.

DETAILED DESCRIPTION OF THE INVENTION

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Structural Components

Figure 1:
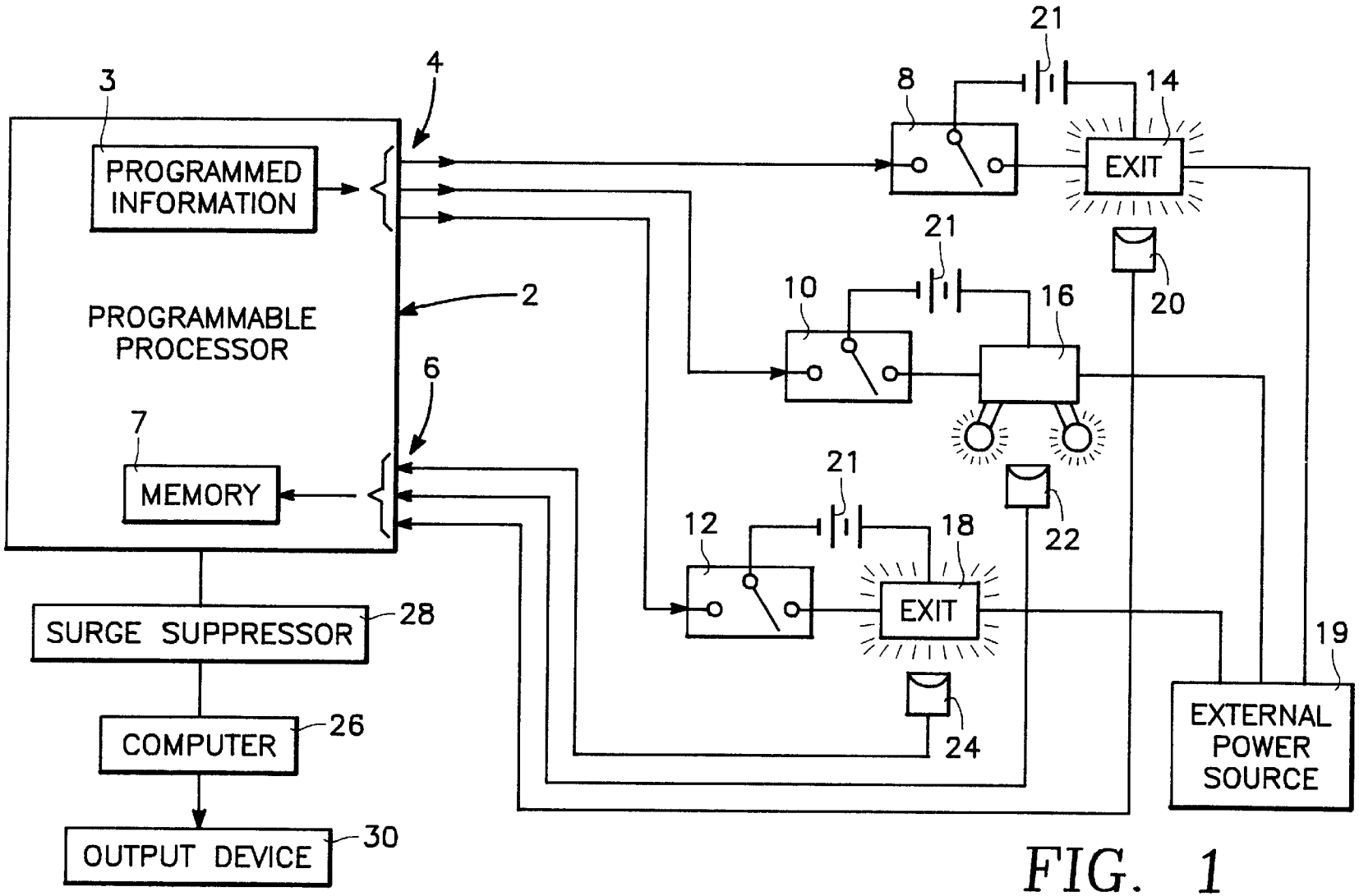
FIG. 1 is an overall structural block diagram of the present invention.

FIG. 1 is a structural block diagram showing an overview of the electronic system of the present invention for monitoring and testing emergency luminare. The invention comprises a programmable processor 2 which can be a circuit board or a microprocessor. The programmable processor 2 includes programmed information 3, a plurality of timed signal out ports 4 receiving the programmed information 3 to produce low voltage or low current signals, a plurality of data in ports 6 for receiving data, and memory 7 for storing the received data.

The programmable processor 2 is pre-programmed with the programmed information 3 to provide the low voltage or low current signals at predetermined times for predetermined intervals at the timed signal out ports 4. For example, the programmable processor 2 can be programmed to provide low voltage signals at 1:00 a.m. for a period of two hours. Each timed signal out port 4 may be programmed to be independently activated.

The number of timed signal out ports 4 are equal to the number of data in ports 6, which are equal to the number of emergency luminare that the system is designed to test. For example, for illustrative purposes, FIG. 1 shows three timed signal out ports 4 and three data in ports 6.

The programmable processor 2 is coupled to three switches 8, 10 and 12, through the timed signal out ports 4. The invention also includes luminary 14, 16, 18 powered by an external continuous power source 19 and an internal back-up battery source 21. The luminare can represent any type of emergency luminary, including, but not limited to, exit signs, sealed beam lights, florescent and/or any other types, and wall packs. For illustrative purposes only, the emergency luminare 14, 16, and 18 are symbolically shown as an exit sign, a sealed beam light, and another exit sign, respectively.

Each switch 8, 10, and 12 is coupled to the power source 19 of the respective emergency luminare 14, 16, 18. The power source 19 of each emergency luminary is provided by the buildings that house the luminare and can range in any applied voltage.

The switches can be either a conventional and commercially available single pole or double pole switch, depending on the type of emergency luminare that the particular switch is coupled to. For example, an exit sign that is normally off and is connected to one power line from the building requires a single pole switch to disconnect that power line. However, florescent sealed beam hallway lights, which are powered by a wall switch as well as the external power source, need a double pole switch to be disconnected.

The present invention also includes a plurality of detectors 20, 22, 24. Each detector 20, 22, and 24 is coupled between one data port 6 of the programmable processor 2 and one of the emergency luminare 14, 16, 18, respectively. The detectors 20, 22, 24 detect the operational status of the respective emergency luminare 14, 16, 18.

The detectors 20, 22, 24 can be any device suitable for detecting the operational status of an emergency luminary, such as, photosensitive detectors suitably positioned to detect light emitted from an active emergency luminary. In the case of a photosensitive detector, the photosensitive detector would provide a current or voltage output signal to the programmable processor 2, such as closing or completing a circuit to the programmable processor 2, upon the detection of light emitted by the respective emergency luminare. The detectors can also be current transformers interconnected to respective emergency luminare for detecting current flow. In the case of a current transformer, if the current transformer detects current flow within the circuitry of an emergency luminary, a voltage or current output signal is produced and provided to the programmable processor 2.

The programmable processor 2 is further coupled to a user accessible computer 26 via a data line for transferring data to the computer 26. A protective surge suppressor 28 is preferably interconnected between the programmable processor 2 and the computer 26. The data line can be a communications line, such as a typical phone line. The surge suppressor 28 has the capacity of preventing surges from the data line to the processor 2. The computer 26 is further connected to a printer 30 which can provide a printout or hard copy of the data transferred to the computer 26 from the processor 2.

Operation

Figure 2:
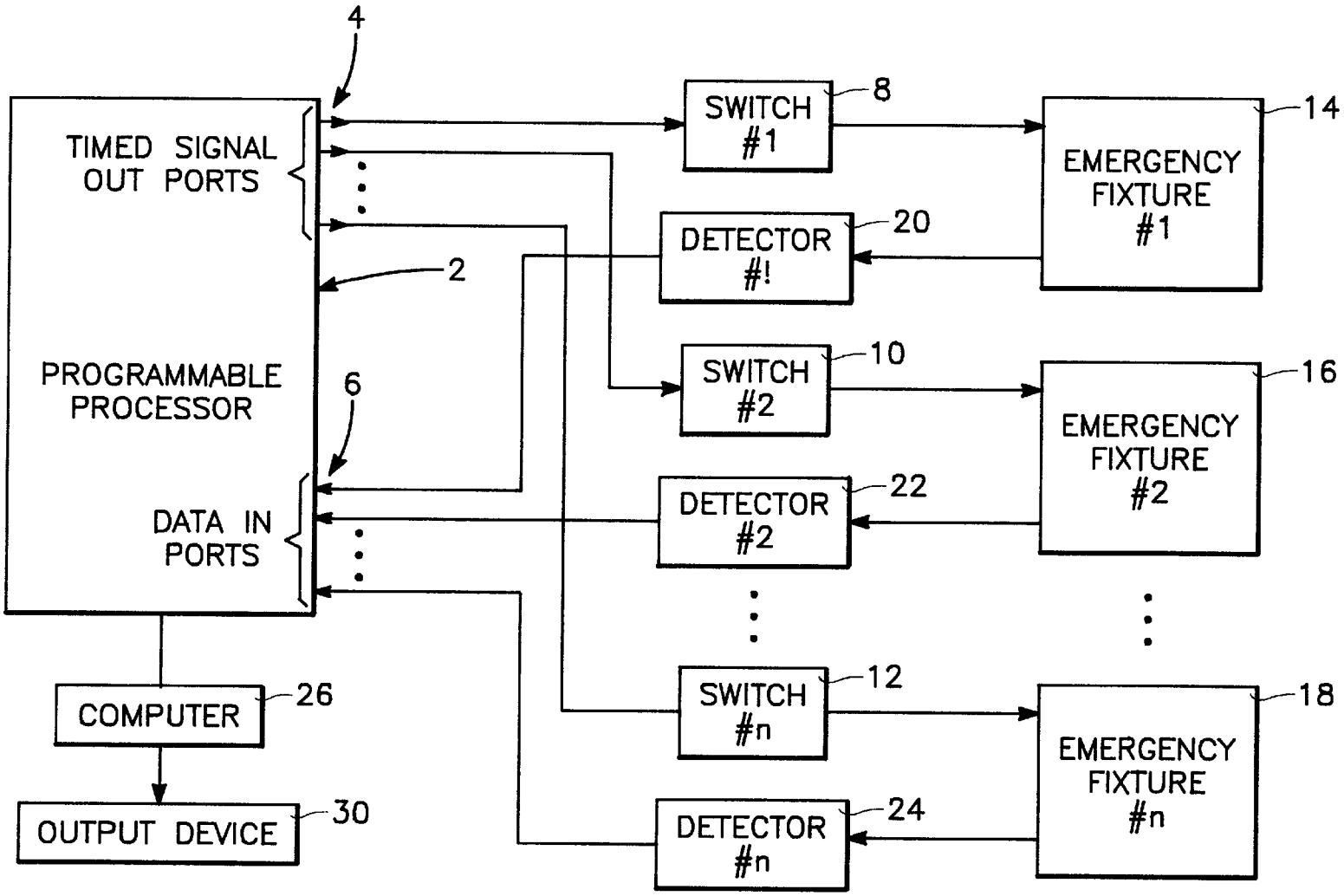
FIG. 2 is a functional block diagram of the present invention.

FIG. 2 is a block diagram of the present invention for monitoring and testing n number of emergency luminare. Programmable processor 2 is pre-programmed to provide n low voltage or low current signals at predetermined times for predetermined intervals at the timed signal out ports 4.

FIG. 2 shows the times signal out ports 4 and the data in ports 6 each with a first and second signal with a continuation of signals symbolically indicated by dots. Switches #1, #2, and #n 8, 10, 12 are coupled to a plurality of emergency luminare #1, #2, and #n 14, 16, 18, respectively, with dots symbolically indicating a continuation of switches and luminare. The switches receive respective signals from the timed signal out ports 4 to turn the switches on in order to activate the respective battery sources 21 (shown in FIG. 1) of the emergency luminare for testing their functionality.

Detectors #1, #2, and #n 20, 22, 24, with dots symbolically indicating a continuation of detectors, are coupled to emergency luminare #1, #2, and #n, 14, 16, 18, respectively. Each detector collects data of the operational status of the respective emergency luminare. In one embodiment, each detector sends an output signal to one of the data in ports 6 of the programmable processor 2. The output signal contains information regarding the operational status of the particular luminary. The processor 2 receives the output signal and from this signal determines whether the particular luminary is operating properly.

In another embodiment, each detector is a detection circuit which sends an output signal to the data in port 6 of the programmable processor 2 only if the respective luminary is operating properly. If the respective luminary is not operating properly, no signal is sent. As a result, in this embodiment, if the processor 2 receives a signal, the particular luminary is operating properly. In contrast, if the processor 2 does not receive a signal, the particular luminary is not operating properly.

Information such as the time and duration are contained in the output signals provided to the processor 2 from each detector and are stored in the data memory of the processor 2 as information on the operational status of the emergency luminare #1 to #n. The computer 26 is coupled to the processor 2 for receiving the data stored in the processor 2 and for providing a user accessible readout of the operational status of the luminare. Also, the computer 26 can be used to preprogram or alter the programming of the processor 2.

The processor 2, switches 8, 10, 12, and detectors 20, 22, 24 can be located in the building or on, next to, or adjacent luminare #1 to #n 14, 16, 18 to be monitored. However, the computer 26 can be located at a remote location and connected to the processor 2 through a data communications line, such as a phone line, for programming tests and for retrieving stored data on the operational status of the emergency luminare. Thus, the emergency luminare 14, 16, 18 in a building are electronically tested via the remote computer 26 without requiring manual entry into the building.

Specifically, referring to FIG. 1 along with FIG. 2, in the preferred embodiment, the programmable processor 2 is programmed to activate the timed signal out ports 4 to turn on the respective switches to which each out port is coupled. The processor 2 is programmed to activate each out port at a predetermined time for a predetermined interval with each port programmed independently. Among the factors to consider in programming the processor 2, are the type of luminare connected to each line, the period of testing for a specific luminare, as required by the building codes, and the periods that the building is unoccupied so that testing can take place.

Once a switch is turned on, the power source 19 to the respective emergency luminary is disconnected, causing the internal battery source 21 of the respective luminary to activate the luminary. For example, if the timed signal out port 4 connecting the processor 2 to switch 8 activates, then the switch 8 disconnects the power source 19 to the luminary 14. The battery source 21 of luminary 14 then powers and activates the luminary 14, turning its exit light on.

Once a luminary is activated, its respective detector, such as the detection circuit described above, detects if the luminary is on and properly operating. The detection circuit activates the respective data in port 6 of the processor 2. The processor 2 receives the activation signal from the detection circuit and processes the signal into information about the luminary, such as the length of time the luminary was properly functioning.

This information is stored in the memory of the processor 2. For example, for one type of detection circuit, if luminary 14 is activated, its respective detection circuit 20 detects if the luminary is properly operating. If the luminary 14 is properly operating, the detection circuit 20 then activates the data in port 6, indicating that the luminary 14 is properly operating.

However, if the luminary 14 is not properly operating, then no signal is sent to the processor 2 from the detection circuit 20. The processor 2 records in memory the information it receives at its data in port 6 from the detection circuits 20, 22 and 24. This information is then sent to the computer 26 for monitoring, either on the computer's video display or through a printout. A user accessing the computer 26 can also modify or reprogram the testing sequence.

Thus, the present invention provides electronic monitoring and testing of a building's emergency luminare quickly and remotely without manual entry into the building. Further, since the processor 2 is programmable, flexible testing schedules can be arranged without interfering with the operations of the building.

Figure 3:
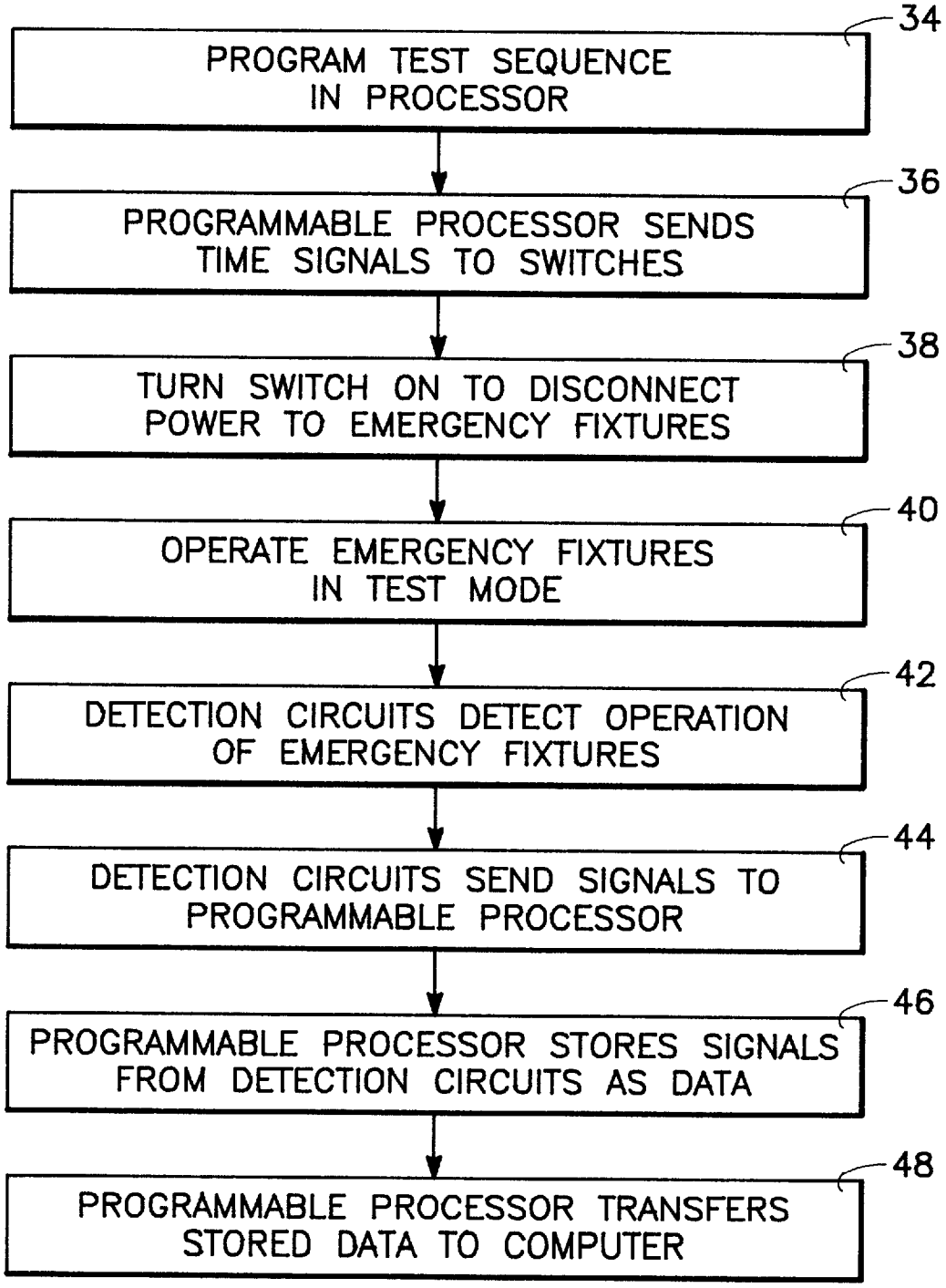
FIG. 3 is a flow chart illustrating a method of the present invention for electronically testing emergency luminare.

FIG. 3 shows a flow chart illustrating a sample method of the present invention of electronically testing emergency luminare. In the discussion that follows, reference is made to the components of the system shown in FIGS. 1 and 2 along with FIG. 3. First, the programmable processor 2 is preprogrammed 34 with programmed information 3 consisting of a testing sequence or schedule at predetermined times and for predetermined intervals.

At the predetermined times, the processor 2 sends 36 timed signals to respective switches. The timed signals turn respective switches on which disconnects 38 the power supply 19 to respective emergency luminare. The processor 2 may be programmed to turn on the switches independently of one another. For example, the processor 2 may be programmed to send a timed signal to switches 8 and 10 at 1:00 a.m. with switch 8 being on for two hours and switch 10 being on for three hours. Further, switch 12 could be turned on at 2:00 a.m. and remain on for only one hour. Numerous testing sequences are possible.

Once the respective power supply of the respective luminary is switched off, the respective luminary operates 40 in test mode by the battery source 21. The respective detection circuits then detect 42 the operation of the respective luminary and sends 44 a signal to the processor 2. If the respective luminary is not properly operating, then no signal is sent to the processor 2. The processor 2 then records 46 the duration of the signals from the respective detection circuits in memory as data, or information, on the operational status of the respective emergency luminary. This data is then transferred 48 to the computer 26 allowing for user access of the operational status of the emergency luminare 14, 16 and 18.

This concludes the description of the preferred embodiment of the invention. The foregoing description of the invention's preferred embodiment has been presented for the purposes of illustration and description. It is not intended to be exhaustive or to limit the invention to the precise form disclosed. Many modifications and variations are possible in the light of the above teaching. It is intended that the scope of the invention be limited not by this description, but rather by the claims appended hereto.

What is claimed is:

1. An apparatus for electronically monitoring and testing operational status of emergency devices, comprising:

a programmable processor pre-programmed with programmed information adaptably coupled to at least one existing emergency luminary device powered by an external power source and an internal independent back-up battery source, wherein said processor produces electrical input signals at predetermined times for predetermined intervals;

at least one switch, electronically coupled between said programmable processor and at least one of the emergency luminare, for receiving said electrical input signals at random times to randomly deactivate the external power source and to activate the internal battery source;

at least one detector, electronically coupled between at least one of the emergency luminare and said programmable processor, for collecting data containing the operational status of the respective emergency luminary;

wherein said programmable processor receives and stores said data in a memory means of the programmable processor.

2. The apparatus as set forth in claim 1, wherein said switches are single pole relays.

3. The apparatus as set forth in claim 1, wherein said switches are double pole relays.

4. The apparatus as set forth in claim 1, wherein said detectors are comprised of photosensitive detectors.

5. The apparatus as set forth in claim 1, wherein said detectors are comprised of current transformers.

6. The apparatus as set forth in claim 1, further comprising a computer, coupled to the programmable processor through a data line, for receiving the data in the programmable processor's memory.

7. The apparatus as set forth in claim 6, wherein said data line through which said computer is coupled to said programmable processor is a phone line.

8. The apparatus as in claim 6, further comprising a surge suppressor through which said data line coupling said computer and said programmable processor is connected for preventing electrical surge damage to said programmable processor.

9. A method of electronically monitoring and testing the operational status of emergency devices, comprising the steps of:

(a) programming a programmable processor with programmed information so that said programmable processor is adaptable for use with at least one existing emergency luminary device powered by an external power source and an internal independent back-up battery source to provide at least one electrical input signal for at least one emergency luminary at predetermined times for predetermined intervals;

(b) receiving said electrical input signal by at least one switch coupled to at least one emergency luminary at random times to randomly deactivate the external power source and to activate the internal battery source;

(c) collecting data containing the operational status of at least one emergency luminary by at least one detector; and (d) receiving, storing, and processing said data by said programmable processor.

10. The method as set forth in claim 9, further comprising the step of electronically transferring the data from said programmable processor to a computer for providing user access to the data.

11. An apparatus for electronically monitoring and testing operational status of emergency devices, comprising:

a programmable processor pre-programmed with programmed information adaptably coupled to at least one existing emergency luminary device powered by an external power source and an internal independent back-up battery source, wherein said processor produces electrical input signals at predetermined times for predetermined intervals;

a plurality of switches, each electronically coupled between said programmable processor and one of said emergency luminare, for receiving said electrical input signals at random times to randomly deactivate the external power source and to activate the internal battery source; and a plurality of detectors, each electronically coupled between one of said emergency luminare and said programmable processor, for detecting the operational status of a respective emergency luminary, wherein each detector provides an output signal to said programmable processor if a respective internal battery source properly powers a respective emergency luminary after being activated by one of said switches;

wherein said programmable processor stores said output signals as data in a memory means of the programmable processor.

12. The apparatus as set forth in claim 11, wherein said switches are single pole relays.

13. The apparatus as set forth in claim 11, wherein said switches are double pole relays.

14. The apparatus as set forth in claim 11, wherein said detectors are comprised of photosensitive detectors.

15. The apparatus as set forth in claim 11, wherein said detectors are comprised of current transformers.

16. The apparatus as set forth in claim 11, further comprising a computer, coupled to the programmable processor through a data line, for receiving the data in the programmable processor's memory.

17. The apparatus as set forth in claim 16, wherein said data line through which said computer is coupled to said programmable processor is a phone line.

18. The apparatus as in claim 16, further comprising a surge suppressor through which said data line coupling said computer and said programmable processor is connected for preventing electrical surge damage to said programmable processor.

19. The apparatus as set forth in claim 16, wherein said computer is capable of being pre-programmable for altering said programmed information of said programmable processor.

20. The apparatus as set forth in claim 16, further comprising an output device coupled to said computer for producing user readable information.

* * * * *